United States Patent [19]

Matos Teodosio et al.

[11] Patent Number: 4,746,312

[45] Date of Patent: May 24, 1988

[54] OCCUPANT-PROPELLED MARINE VESSEL

[76] Inventors: José Matos Teodosio; Manuel Martin Garcia, both of Ramón Talero, 20, El Repilago-Jabugo (Huelva), Spain

[21] Appl. No.: 790,850

[22] Filed: Oct. 24, 1985

[30] Foreign Application Priority Data

Oct. 29, 1984 [ES] Spain ..... 282328

[51] Int. Cl.[4] ..... B63B 35/72

[52] U.S. Cl. ..... 440/21; 440/31; 74/812

[58] Field of Search ..... 440/21, 20, 24, 1, 32; 280/1.11 R, 7.15, 252, 253, 257; 74/812

[56] References Cited

U.S. PATENT DOCUMENTS

| | | | |
|---|---|---|---|
| 708,286 | 9/1902 | Wild, Jr. | 74/812 |
| 2,505,841 | 5/1950 | Shuker et al. | 74/812 |
| 2,596,194 | 5/1952 | Anderson | 114/123 |
| 3,954,077 | 5/1976 | Piat-Marchand | 114/123 |
| 3,996,874 | 12/1976 | Winch | 440/26 |
| 4,318,700 | 3/1982 | Price | 440/26 |

FOREIGN PATENT DOCUMENTS

| | | | |
|---|---|---|---|
| 1025156 | 4/1953 | France | 440/29 |
| 1398260 | 12/1965 | France . | |
| 450841 | 8/1949 | Italy | 440/32 |
| 515627 | 3/1957 | Italy | 114/357 |
| 700963 | 12/1953 | United Kingdom | 440/30 |

*Primary Examiner*—Joseph F. Peters, Jr.
*Assistant Examiner*—Edwin L. Swinehart
*Attorney, Agent, or Firm*—Kirschstein, Kirschstein, Ottinger & Israel

[57] ABSTRACT

A water craft constituted by a fiberglass body with a streamlined bow in back of which is a recess forming a seating compartment. The rear end of the body is formed to provide a keel. Front-to-back guides in the seating compartment support a shiftable seat having dismountable arms that extend laterally to opposite sides of the body to support floats at their ends. In front of the seat, pedals are supplied which are kinematically joined to a central shaft within the body that is connected to a drive shaft that emerges from the body for driving a propeller.

7 Claims, 3 Drawing Sheets

OCCUPANT-PROPELLED MARINE VESSEL

BACKGROUND OF THE INVENTION

Field of the Invention

The present invention concerns an occupant-propelled nautical vehicle.

SUMMARY OF THE INVENTION

This new nautical vehicle, whose structure is a notable improvement over the one covered by Spanish utility model Pat. No. 278.528 of the same applicants, and also because it perfects the reversing mechanism by the movement and drive described partly in Spanish utility model Pat. No. 276.962, by these same applicants, is basically formed of a floating central body, fitted preferably with a seat. The vehicle comprises a pair of dismountable lateral arms which hold floats, and also a rear rudder and a rear keel located below the float line. The vehicle can move smoothly over any liquid surface thanks to its large floating plane and also the very little effort which is needed for its drive. For this drive, the muscular effort produced by the legs of the user shall be a decisive factor, as they work with a rocking movement on a couple of front pedals which will transmit it to an interior, longitudinal shaft. This rocking action is converted to a unidirectional rotary force and movement by a mechanism which will be described later, and which will transmit it to the shaft of the corresponding drive propeller.

The idea of this boat is therefore new regarding its very structure, and also, mainly its drive system which, as already mentioned, consists of taking advantage of a rocking movement, and consequently a gentle, light movement, transforming it into a continuous one-way movement.

It is extremely easy to handle this boat and since it does not need oars, it leaves the user's hands free, for fishing, hunting, etc. all during sailing.

Thanks to its enormous floating power and since it has two side floats which stabilize it, and as it is also hermetically sealed, the action of the waves does not sink or capsize it, and allow very easy manoeuvres to be carried out using a rear rudder which can be worked indistinctly with both hands.

The entire body of the boat will be made in fibreglass, and the drive mechanism will be nylon fibre and stainless steel and consequently will not be affected by the corrosive effects of water.

On the other hand, the fact that the side arms with their floats can be easily dismantled, makes it easy for the boat to be transported, for example, on a car-rack, and it also occupies a smaller space when not in use.

Furthermore, it presents the variant that through a simple transformation, it can be converted into a wide catamaran, for which and counting on two units of the central body arranged parallel to one another and with at least one end without arms and floats, they can be joined by means of an intermediary ribbing, leaving a useful space which can be used for loading underwater fishing equipment, etc.

BRIEF DESCRIPTION OF THE DRAWINGS

In order to correctly understand this object, two sheets of drawings are enclosed with this descriptive memorandum, which by way of example, all and each part making it up are represented.

The following is represented in these sheets of drawings.

DETAILED DESCRIPTION OF THE PREFERRED EMBODIMENTS

Figure 1:
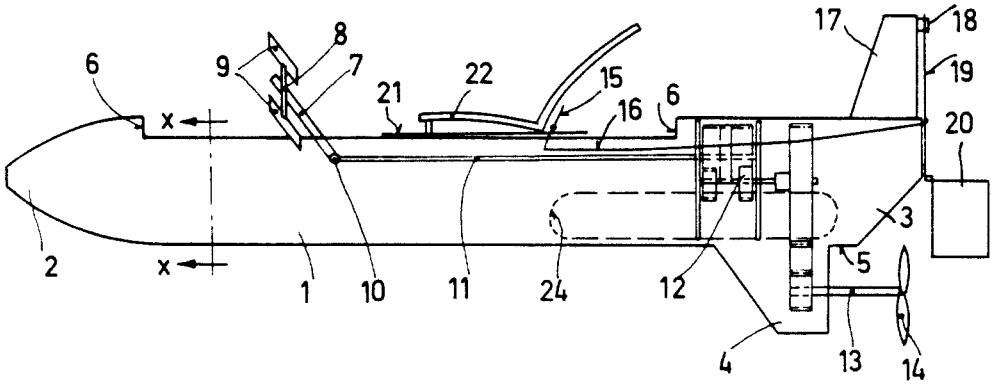
FIG. 1 is a side view of the boat, with its internal mechanism.
Figure 2:
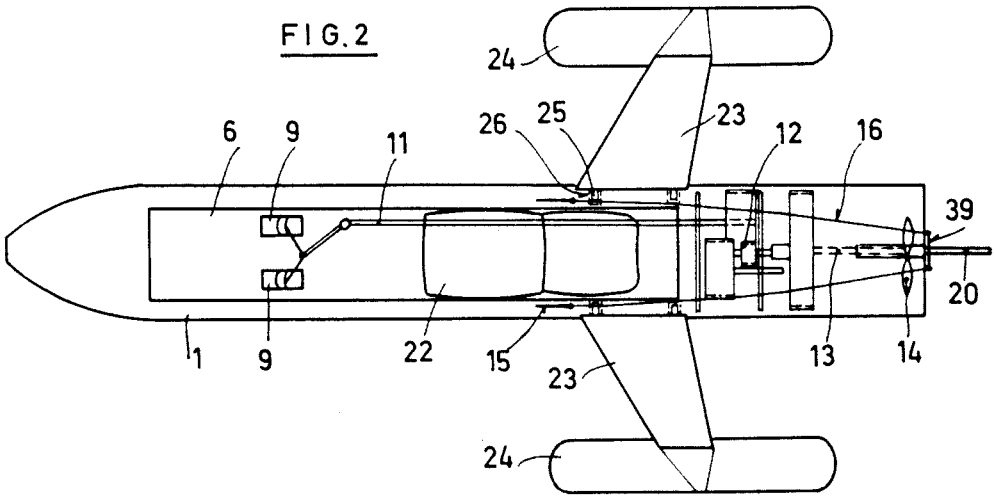
FIG. 2 is a top plan view of FIG. 1.
Figure 4:
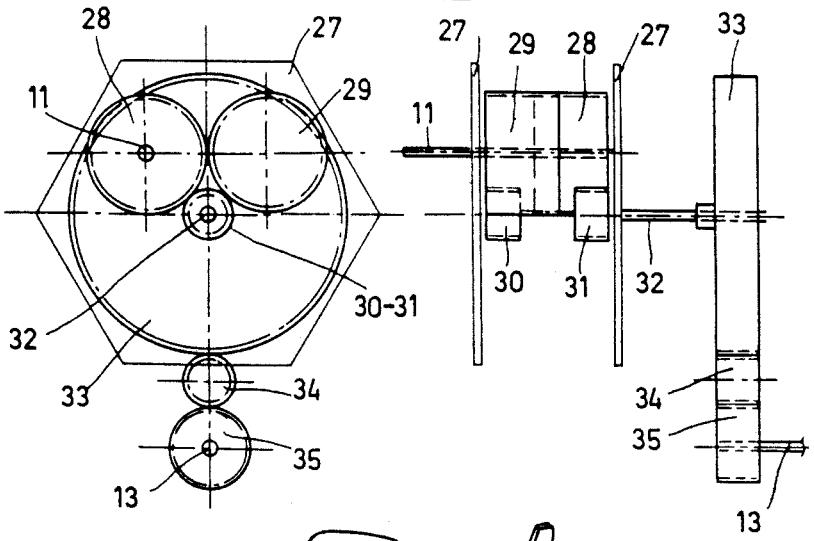
FIGS. 4(*a*) and 4(*b*) are front and side views of a detail of the drive reversing device.
Figure 3:
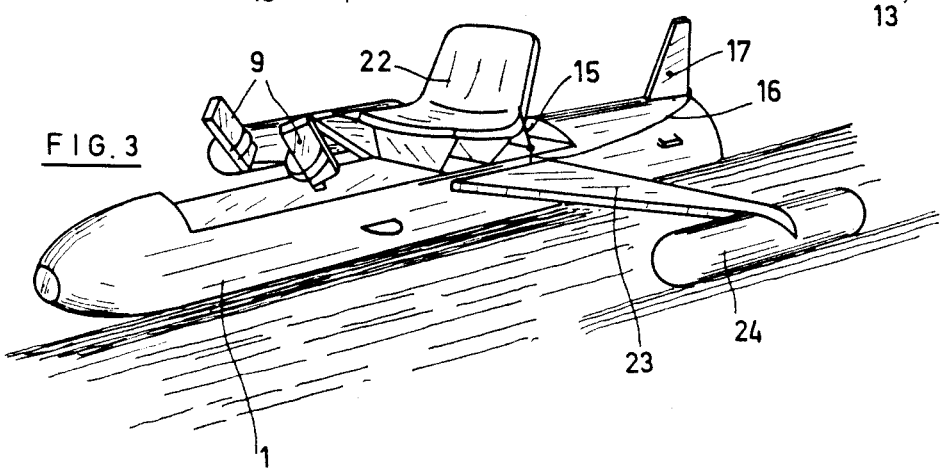
FIG. 3 is a perspective view of the boat.
Figure 5:
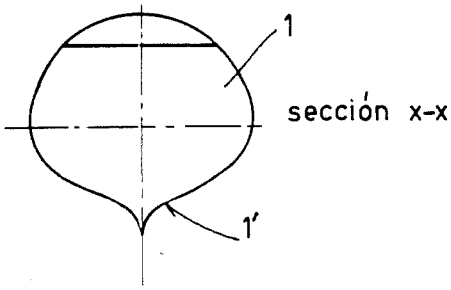
FIG. 5 is a sectional view of the central body section and floats as taken on line x—x of FIG. 1.
Figure 6:
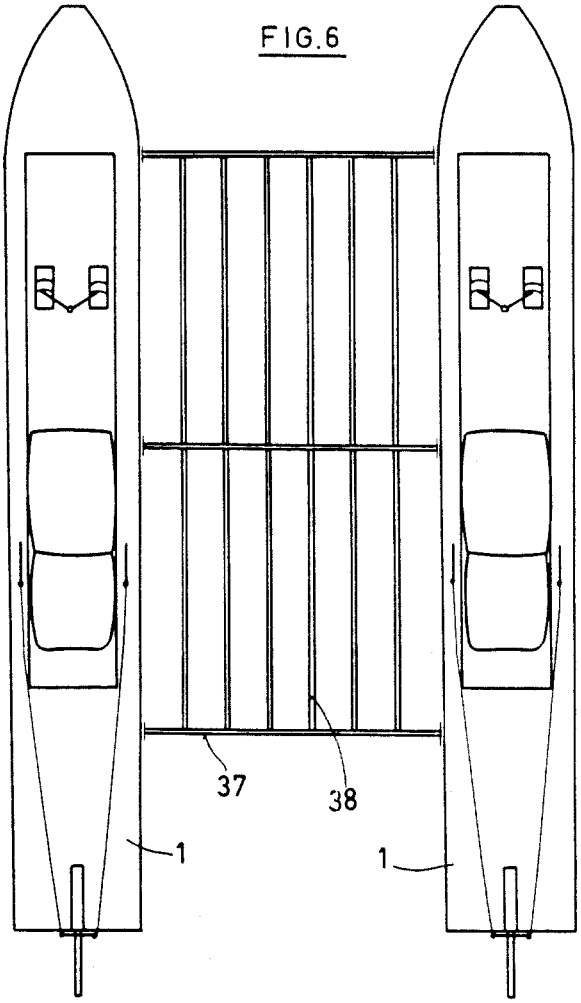
FIG. 6 is a top plan view of a variant, transforming the boat into a catamaran.

In the drawings, with the same reference numerals, the following main parts are referenced:

The nautical vehicle is made up of a central tubular body 1 of aerodynamic shape, built in fibre-glass, which has a bow 2 which tends to reduce its diameter, with its lower plane 1 streamlined by two planes which tend to converge in a slender central vertex, which gives it a minimum friction profile in its movement over the water. At the rear the body has a bevel 3 beneath which is the corresponding propeller 14, with a keel 4 in this area and below the float line. The keel is sighted by a space 5 which limits it with the above mentioned bevel.

The upper surface of the body 1 has a longitudinal slot 6 and a flat casing, where there is a seating 22 towards the rear, which is fixed and with possibility of movement along guides 21. A couple of pedals 9 in front, that is to say, in the front part of the boat, are fixed to the ends of braces 8 and these in turn to a common central shaft 7 which emerges from the surface of the vehicle. The shaft is projected inside until it meets through a cardan joint 10 a longitudinal axle 11. At the other end the axle is connected to a reversing device 12 from which finally the drive shaft 13 emerges on which propeller 14 is fitted.

At the rear of the body 1 and on its upper plane, it has an upright aileron 17 which secures an orientable rod 19 by means of a clamp 18 and which runs right along the rear plane of the boat until it reaches the position of the bevel 3, at which point there is a rudder 20. At the bottom of this aileron there is a brace 39 at the sides of which some cable ends are secured 16 located on either side of the vehicle and which run down to drive levers 15 which are located coinciding with the rear part of the seating 22 so that when these levers are worked, the rudder is moved to the left or right indistinctly.

At the rear third of the vehicle there are dismountable side arms 23 which are tapered and bent backwards, containing floats 24 at the ends which have a section 1' at the bottom which is identical to that of the central body to provide a better sliding movement. In the part where they join the body, these arms have pivots 25 which are inserted in bore 26 arranged for this purpose in the central body; the joint is assured by a couple of strips which are secured by a screw.

The reversing movement device 12 which is fitted at the rear of the vehicle and which also covers the inside of the keel 14, is assembled on two supporting planes 27 which fit inside the body 1. Two identical primary and secondary cogwheels 28 29 are fitted between these planes, which connect tangentially but only in one part of thickness; one of them is fitted on the end of the longitudinal shaft 11. These wheels, in turn, will each connect into another pair of smaller tertiary cogwheels 30 31 which have half the thickness of the previous ones and are fitted on a central shaft 32 and respectively have a ratchet which holds or releases them depending on the description of the operation which will be given below.

The central shaft 32 which the smaller wheels are assembled on, is extended at the outside of the supporting planes 27 so that at one end it has a large first cogged wheel 33. Underneath this latter wheel, and inside the part which corresponds to the keel 4, there is another second cogged wheel 34 which absorbs and makes it possible to lower the propeller plane below the float line, and introduce it in the water; and lastly, this additional wheel is geared to a final third cogged wheel 35 from which the output shaft comes out 13 which emerges outside and receives the propeller 14 which is fitted below the bevel 3 and is protected by the body of the keel 4.

The performance of this movement reverser 12 is determined by the action of the user of the vehicle on the pedals 9 so that when these are moved, shaft 7 is turned; this movement will be transmitted by the cardan 10 to the longitudinal shaft 11 and from here to the reversing mechanism, so that if the movement which is transmitted has a left-right direction, the wheel 28 will turn in this same direction and in turn will lock in the smaller wheel 31 which will turn in a contrary direction, that is to say right-left; its ratchet will remain loose and will not operate on its shaft 32. Whilst this is happening and since wheel 28 is locked with its twin 29, it makes this turn in a right-left direction, and the latter in turn, the opposite way to the smaller twin wheel 30 which works by its ratchet on the central shaft 32, so that this turns from left to right like the crown wheel 33 with which it is solidary.

The second possibility, in other words shaft 11 turns in a right-left direction, and wheel 28 which will turn in this direction will operate in countersense on wheel 31 so that the ratchet which is locked will work on the shaft, and likewise will cause this to turn as in the above case, in left-right direction like the crown wheel 33; in this movement, wheel 29 pulled by 28 will turn from left-right, and at the same time wheel 30 which will not work by its ratchet on the central shaft 32 will do so from right-left, leaving this shaft free, which will however be worked by the twin wheel 31.

Based on the above description for working the reversing mechanism 12, the rocking movement on the pedals 9 is made from right or left, indistinctly; the resultant on the outlet shaft 32 will always be in the same direction, i.e. left-right, which will make the big wheel 33 move in this direction, so that this, through the complementary wheel 34 will make the outlet wheel 35 turn, which will move its shaft 13 which contains the propeller 14 and will determine its drive and consequently make the boat move.

Lastly, and in the likely event that the boat structure is to be enlarged, arms 23 should be dismounted with their respective floats, leaving just the central body 1 to join a second body which is arranged parallel to the other, and incorporating linkage 37 38 which is fixed to the corresponding side borings and is protected by the corresponding waterproof joints, to form a catamaran nautical vehicle.

After sufficiently describing the nature of the model, it is expressly declared that any modification in details which is introduced in same shall be considered included within this protection, so long as it does not alter or essentially modify its characteristic purpose.

What is claimed is:

1. An occupant-propelled marine vessel, comprising:

(a) an elongated main body buoyant in water and being of streamlined construction, said body extending from a bow at the front of the body along a longitudinal axis to a stern at the rear of the body, said body having a submerged keel lying in a vertical plane longitudinally extending centrally through the body, and a single submerged rudder mounted at the stern for pivoting movement about a vertical axis normal to said longitudinal axis, said body further having an above-water deck and an interior below the deck;

(b) a pair of side arms mounted at opposite sides, and extending transversely, of the main body;

(c) a pair of side floats buoyant in water and being of streamlined construction, said side floats being respectively mounted at outer ends of the side arms at opposite sides of the vertical plane;

(d) a seat mounted on the deck for adjustment along the longitudinal axis; and (e) occupant-propulsion means for enabling a seated occupant to forwardly propel the vessel by the use of the occupant's feet, including (i) a pedal shaft in front of the seat and extending along an inclined pedal axis from the interior both forwardly and upwardly through the deck, (ii) two foot pedals connected above the deck to the pedal shaft at opposite sides thereof and engageable with the occupant's feet, for repetitively driving the pedal shaft in alternate directions about the inclined pedal axis, (iii) a drive shaft within the interior of the body and extending longitudinally along a drive axis, said drive shaft being operatively connected to the pedal shaft and being turnable in alternate directions about the drive axis, (iv) an outboard propeller mounted at the stern on an output shaft for joint rotation with the output shaft about an output axis parallel to the longitudinal axis, and (v) a reversing transmission within the interior of the body and operatively connected between the drive shaft and the output shaft, for converting the alternate turning of the drive shaft into a uni-directional rotation of the output shaft together with the propeller, thereby forwardly propelling the vessel regardless of the direction in which the drive shaft is turned, said reversing transmission including a primary gear mounted on the drive shaft for joint turning in alternate directions about the drive axis, a secondary gear in meshing engagement with the primary gear and turnable in alternate directions by the primary gear about a first gear axis parallel to the drive axis, and a pair of tertiary gears colinearly mounted on a gear shaft extending along a second gear axis parallel to the first gear axis, one of the tertiary gears being in meshing engagement with the primary gear and operative for turning the gear shaft solely in one predetermined direction, the other of the tertiary gears being in meshing engagement with the secondary gear and operative for turning the gear shaft solely in said same one predetermined direction.

2. The vessel as recited in claim 1, wherein the reversing transmission further includes a first cog wheel mounted on the gear shaft for joint rotation therewith solely in said one predetermined direction, a second cog wheel being mounted on the output shaft for rotating the same, and a third cog wheel in meshing engagement between the first and second cog wheels for transferring the turning movement from the gear shaft to the output shaft.

3. The vessel as recited in claim 1; and further comprising steering means including a pair of handles mounted at either side of the seat, and a force-transmitting elongated cable having one end connected to each handle and an opposite end operatively connected to the rudder, each handle being movable to, in turn, pivot the rudder from a straight-ahead position to a steering position.

4. The vessel as recited in claim 1; and further comprising longitudinal tracks on the deck and along which the seat slides for adjusting the position of the seat relative to the foot pedals.

5. The vessel as recited in claim 1, wherein each side arm has stub shafts removably mounted in corresponding recesses in the body for removal and replacement of each side arm.

6. The vessel as recited in claim 1, wherein the body has outwardly bulging sides which converge toward each other below the waterline and terminate in a tip lying in the vertical plane.

7. The vessel as recited in claim 5; and further comprising an additional body identical to said first-mentioned body, and means for interconnecting the bodies after removal of the side arms and accompanying floats.

* * * * *